United States Patent [19]

Loges et al.

[11] Patent Number: 4,627,258

[45] Date of Patent: Dec. 9, 1986

[54] APPARATUS FOR IMPRESSING A STRIP ALONG ITS EDGE

[75] Inventors: Hans J. Loges; Hermann Wilkening, both of Düsseldorf, Fed. Rep. of Germany

[73] Assignee: IOG Industrie-Ofenbau Gesellschaft mit beschrankter Haftung, Düsseldorf, Fed. Rep. of Germany

[21] Appl. No.: 750,856

[22] Filed: Jul. 1, 1985

[30] Foreign Application Priority Data

Jun. 30, 1984 [DE] Fed. Rep. of Germany ... 8419637[U]

[51] Int. Cl.[4] ..... B21D 13/04; B21D 37/04; B21D 37/06

[52] U.S. Cl. ..... 72/196; 72/197; 72/465; 72/466; 72/475

[58] Field of Search ..... 72/17, 187, 196, 197, 72/465, 466, 475, 190–192, 184, 147; 226/60

[56] References Cited

U.S. PATENT DOCUMENTS

| | | | |
|---|---|---|---|
| 1,148,670 | 8/1915 | Fedders | 72/196 |
| 1,657,695 | 1/1928 | Richardson | 72/196 |
| 2,022,082 | 11/1935 | Fisher et al. | 72/196 |
| 2,082,456 | 6/1937 | Liedtke et al. | 226/60 |
| 2,257,760 | 10/1941 | Nyberg | 72/196 |
| 2,669,452 | 2/1954 | White | 226/60 |
| 3,239,912 | 3/1966 | Baumgartner et al. | 72/185 |
| 4,052,873 | 10/1977 | Murzin et al. | 72/190 |
| 4,160,371 | 7/1979 | Wilkening et al. | 72/147 |
| 4,269,342 | 5/1981 | Ellinor | 226/60 |

FOREIGN PATENT DOCUMENTS

| | | | |
|---|---|---|---|
| 2015100 | 10/1973 | Fed. Rep. of Germany | 72/196 |
| 2524763 | 7/1982 | Fed. Rep. of Germany | 72/196 |

*Primary Examiner*—Lowell A. Larson

*Attorney, Agent, or Firm*—Karl F. Ross; Herbert Dubno

[57] ABSTRACT

An apparatus for shaping a strip, especially a metal strip includes a pair of working rolls which are provided with a plurality of forming tools spaced about the circumference of the rolls. Arranged before the working rolls is a pair of guide rolls which run in synchronism with the strip speed. In order to be able to increase the operating speed of the apparatus, i.e. to allow the working rolls to run at a higher speed than the advance speed of the strip, in between the guide rolls and the working rolls a roller is located which is movable in a direction perpendicular to the advance motion of the strip and is supported by the strip itself and by springs located in respective casing. A compensation between the different speeds of the guide rolls and the working rolls is provided by the gradual depression of the roller by the strip against the force of the spring.

18 Claims, 12 Drawing Figures

Fig. 3
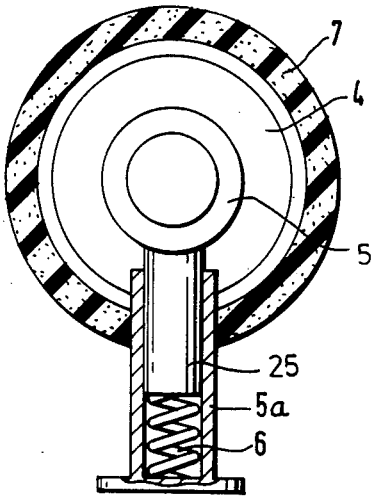
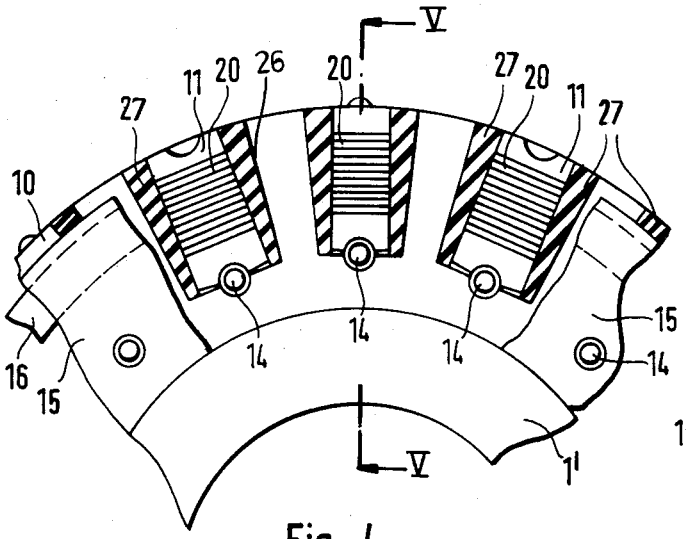
Fig. 4
$C_2$
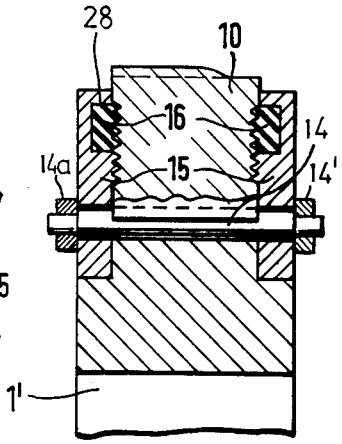
Fig. 5

$C_1$

APPARATUS FOR IMPRESSING A STRIP ALONG ITS EDGE

FIELD OF THE INVENTION

Our present invention refers to an apparatus for shaping a strip, in particular a metal strip, along its edge, i.e. to impress the latter with spaced apart formations.

BACKGROUND OF THE INVENTION

Apparatus for shaping metal strips along their edge, generally make use of at least one pair of working rolls which are provided about their circumference with forming tools composed of male dies and female dies. Arranged in an upstream direction ahead of each pair of working rolls is a pair of guide rolls which runs at about the same speed as the advance speed of the strip From the German patent publication DE-AS No. 20 15 100, strips, especially metal strips are known which are provided with formations or impressions spaced apart along the edge of the strip. The purpose of such formations is to provide a stable coil during winding up of the strip as the formations of successive turns will engage (interfit) with each other when properly.arranged.

From the German patent DE-PS No. 25 24 763 an apparatus for shaping the strip edges is known. In order to obtain the deformations of the strip edge in a desired sequence, the speeds between the strip and the forming tools along the circumference of the tool holders are slightly different depending on the strip thickness and the winding distance. At the moment of embossing the strip edges, the speeds of the strip and the forming tools must, however, be in synchronism. This is achieved by linking the tool holders to their drive mechanisms via elastic connections so that during embossing, the tool holders are entrained briefly by the strip and then are released again. This is disadvantageous as the tool holders cause rotational oscillations affecting the operational speed and establishing limits to an increase of the operational speed.

OBJECT OF THE INVENTION

It is thus the principal object of our present invention to provide an improved apparatus for shaping the edges of strips obviating the afore-stated drawbacks.

SUMMARY OF THE INVENTION

We realize this object, according to the present invention, by interposing a roller between a pair of guide rolls and a pair of working rolls which roller is movable perpendicular to the advance direction of the strip so as to deflect the latter out of its straight transport plane. The roller is supported by springs and thus forced against the underside of the strip.

Through the provision of such an intermediate roller which deflects the strip out of its otherwise straight transport direction, the strip portion between the guide rolls and the working rolls is extended so that irregularities of the operational speed of the working rolls and the thus caused rotational oscillations are basically absorbed. Consequently, the working rolls can rigidly be connected via a gear with the guide rolls while their circumferential speed can exceed the speed with which the strip is advanced thus rendering the apparatus according to the invention more economical.

We have found especially advantageous to provide a second such roller in a downstream portion behind the working rolls to restrict occurring irregularities of the strip movements to a very short strip length.

In order to resiliently support the roller, the latter is connected to trunnions which are movably guided within casings via springs respectively accommodated in the casings. It is especially advantageous to provide the outer jacket of the roller of elastic material so as to further reduce occurring oscillations.

The forces transmitted to the working rolls and the resulting vibrations can still be further diminished when allowing the forming tools to be elastically movable in circumferential direction. This is achieved by housing the forming tools in recesses whose walls are lined by elastic cushions to couch the forming tools. At the base of each recess, a hinge bolt is centrally arranged so that during embossing of the strip edge, the forming tool can tilt about the hinge bolt while the working rolls still run at constant speed. After embossing, the elastic cushions will return the forming tool into its original position. Instead of such cushions, longitudinally slit sleeves which are arranged at each side of the forming tool in the area of the walls of the recesses can be used.

Preferably the recesses are laterally open to position the forming tools in an accurate manner. To fasten the forming tools in the recesses, the open sides are covered by support disks which accommodate elastic rings engaging grooves or ribs of the forming tools.

According to another feature of our present invention, the forming tools may also be accommodated in individual tool holders which are spaced about the circumference of the working rolls and are elastically movable in circumferential direction. The tool holders are connected to the circumference of the working rolls via hinge bolts which allow the tilting motion of the holders and thus of the forming tools. To provide the elasticity, a longitudinally slit sleeve is arranged between two adjacent holders which thus additionally provide a mutual support of the respective holders. Preferably, the connecting lines between the center axis as defined by the sleeve and the center axes as defined by the adjacent hinge bolts encompass a right angle upon a side-elevational projection onto the working rolls so that the movements of adjacent tool holders are prevented from interfering with each other.

Alternatingly, the tool holders can be arranged so as to be shiftable about the circumference of the working rolls. This is achieved by providing springs with their one end connected to the respective tool holder and with their other end connected to the working roll.

BRIEF DESCRIPTION OF THE DRAWING

The above and other features, objects and advantages of our present invention will now be described in more detail with reference to the accompanying highly diagrammatic drawing, in which:

FIG. 3 is a view to a larger scale of a deflecting roller as provided in the region between the guide rolls and working rolls in FIG. 1;

FIG. 4 is a fragmenting transverse section through a second embodiment of the working rolls;

FIG. 5 is a radial section taken along the line V—V in FIG. 4:

SPECIFIC DESCRIPTION

Figure 1:
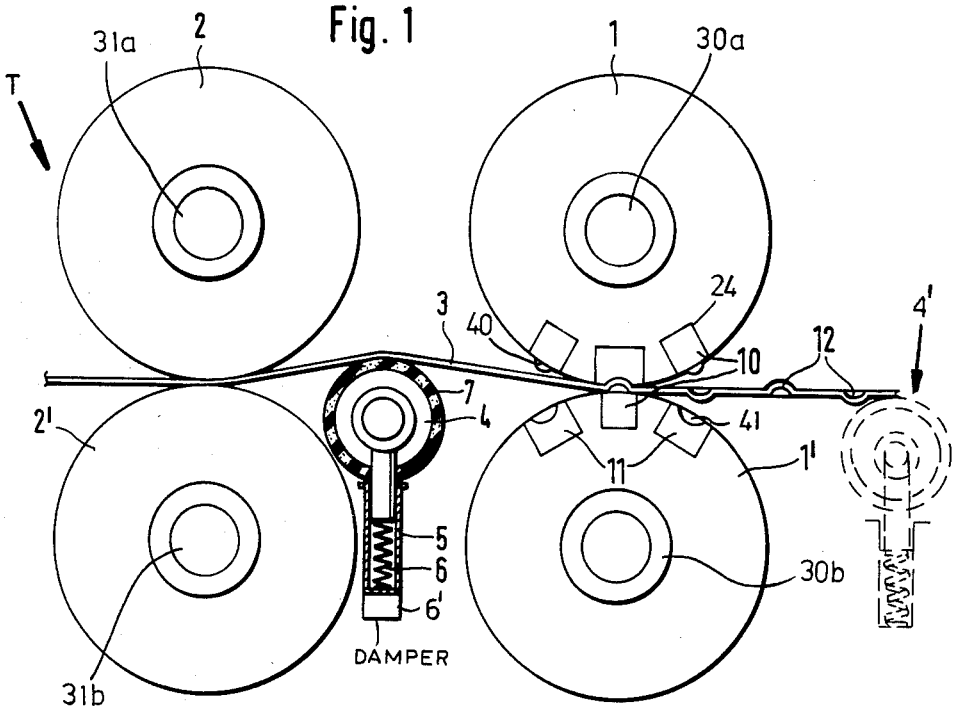
FIG. 1 is a schematic, simplified side-elevational view of a portion of a shaping apparatus according to the invention illustrating a pair of guide rolls and a pair of working rolls.
Figure 2:
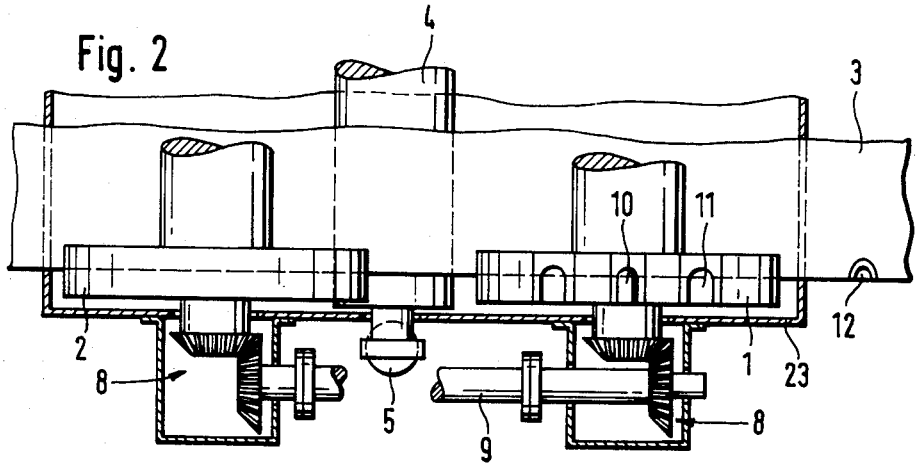
FIG. 2 is a schematic simplified top view of the apparatus of FIG. 1.

In the drawing, we have shown a metal strip 3 adapted to be deformed along its edges by a tandem shaping line T which includes a plurality of pairs of working rolls 1, 1' (only one pair of which is shown) extending along the edge area of the metal strip 3. Associated with each pair of working rolls 1, 1' is a pair of guide ro11s 2, 2' which extends along the edge area of the metal strip at a distance ahead of the respective working rolls 1, 1'.

The working rolls 1, 1' are rotatable about respective shafts 30*a*, 30*b* and arranged above each other to define a gap width through which the metal strip 3 passes. Uniformly spaced along the circumference of each of the rolls 1, 1', are a plurality of recesses 24 in which forming tools 10, 11 are located in such a manner that their center line runs through the center $C_1$, $C_2$ of the rolls 1, 1'. The forming tools are constituted by a male die 10 and a female die 11 which are alternatingly arranged on each roll 1, 1' which means that a male die 10 is followed by a female die 11. The positioning of the forming tools 10, 11 is such that a male die 10 of one roll 1 or 1' engages with the female die 11 of the other roll 1' or 1 when the edge of the metal strip 3 is to be shaped during its treatment by the working rolls 1, 1'.

As indicated in the drawing, each male die 10 is provided with a projection 40 which cooperates with an indentation 41 in the female die 11 so as to provide formations 12 along the edge of the metal strip 3 when the latter passes through the gap width between the rolls 1, 1'. Since—as already mentioned—the rolls 1*a*, 1*b* are alternatingly provided with male and female dies 10, 11, the metal strip 3 is provided at both sides with such formations 12 as clearly illustrated in FIG. 1

The guide rolls 2, 2' rotate about shafts 31*a*, 31*b* and are arranged above each other to define a gap width through which the metal strip 3 passes and guided towards the working rolls 1, 1'. Depending on the requirements, the rolls 2, 2' are provided with a smooth or raised surface.

The working rolls 1, 1' and the guide rolls 2, 2' are each connected via bevel gears 8, a connection shaft 9 and, for instance, via an interposed speed overlay gearing (not shown), such as a variable-ratio coupling, to a common drive mechanism (not shown). The peripheral speed of the guide rolls 2, 2' corresponds essentially to the speed with which the metal strip 3 is advanced whereas the peripheral speed of the working rolls 1, 1' is higher than the advance speed.

Arranged between the guide rolls 2, 2' and the working rolls 1, 1' is a roller 4 which is movable perpendicular to the advance direction of the strip 3 so as to deflect the latter in a direction perpendicular to its transport plane. The roller 4 extends essentially along the entire width of the metal strip 3 and has an outer jacket 7 of elastic material, e.g. of rubber, which contacts the underside of the strip 3. Laterally connected to the roller 4 are trunnions 25 which are resiliently supported by respective springs 6. Each spring 6 is accommodated in a spring casing 5*a* which simultaneously serves a guideway for the associated trunnion 5 during the up and down movement of the roller 4. Consequently, the roller 4 is prestressed by the springs 6 against the strip 3 which is thus deflected out of its straight transport plane in the area between the tandem guide rolls 2, 2' and the tandem working rolls 1, 1'. By providing the deflection of the strip 3 the different circumferential speeds of the guide rolls 2, 2' and the working rolls 1, 1' are compensated.

As shown at 6' in the drawing, a vibration damper can be provided for each spring 6 within the casing 5 in order to counter undesired strip oscillations.

The metal strip 3 is advanced by the guide rolls 2, 2' at a constant speed and fed towards the working rolls 1, 1'. Due to the force applied by the spring 6 on the roller 4, the metal strip 3 is deflected out of its straight transport plane. When being picked up by the working rolls 1, 1', the metal strip 3 will gradually lower the roller 4 as the circumferential speed of the rolls 1, 1' is higher than the circumferential speed of the guide rolls 2, 2' and thus the transport of the strip 3 is accordingly accelerated. By depressing the roller 4 against the force of the spring 6, the different circumferential speeds of the rolls 1, 1' and 2, 2' are compensated so that the shaping or embossing along the edge of the metal strip 3 can be performed without interfering with the gears leading to the drive mechanism.

Consequently, by deflecting the strip 3 out of the straight transport plane through the roller 4, an additional strip length is provided which is necessary to compensate the different speeds of the rolls 1, 1' and 2, 2'. When the treatment of the metal strip by the working rolls 1, 1' is finished, the roller 4 occupies the position as shown in FIG. 1 whereby the strip section between the rolls 1, 1' and 2, 2' is extended by a respective portion.

In order to limit irregularities of the strip motion to a short strip length during embossing, a further roller 4' is located downstream of the embossing rolls 1, 1'.

Turning now to FIG. 4, there is shown a section of a further embodiment of the forming tools 10, 11. While in FIG. 1, the forming tools 10, 11 are rigidly anchored within the recesses 24, FIG. 4 shows an elastic arrangement of the tools 10, 11 in circumferential direction of the rolls 1, 1' so that the generation of oscillating forces in the rolls 1, 1' or in their connection via gears to the drive mechanism is reduced or avoided at all.

Accordingly, the rolls 1, 1' are each provided with a plurality of recesses 26 which are uniformly spaced about the circumference of the rolls 1, 1' and are of truncatedcone shape. Housed in the recesses 26 are the tools 10, 11 such that the latter are arranged with a distance to the wall of the recesses 26. In the so-formed space, wedge-shaped elastic cushions 27 support the tools 10, 11 in a resilient manner. The tools 10, 11 are positioned within the recesses 26 such that their center lines cross the center $C_2$ or $C_1$ of the rolls 1, 1'.

At the base of each recess 26 is a hinge bolt 14 which supports the respective tool 10, 11 in a tilting manner whereby the center axis of the hinge bolt 14 extends parallel to the axis of the rolls 1, 1'. Consequently, during embossing of the metal strip 3, the forming tools 10, 11 are able to follow the advance speed of the strip 3 without interfering with the rotational speed of the rolls 1, 1'.

As is shown in FIG. 5, the circumference of the rolls 1, 1' along which the recesses 26 are provided is somewhat tooth-shaped so that the recesses 26 are laterally open. To retain and clamp the tools 10, 11 within the recesses 26, the respective open sides are closed by support disks 15 which are connected to the hinge bolts 14 via nuts (14') screwed onto threaded stems 14a of the bolts 14. To obtain a secure fixation of the tools 10, 11 to support disks 15, the latter are provided with inner recesses 28 in which elastic rings 16 are inserted. The elastic rings 16 engage in circumferential grooves 20 of the tools 10, 11 to clamp them in a secure manner.

During shaping of the strip edges, the tools 10, 11 tilt about the hinge bolts 14 against the cushions 27 which, once the shaping is finished, will return the tools 10, 11 in its initial position in which their center line crosses the center $C_1$, $C_2$ of the rolls 1, 1' due to their elasticity.

Figure 6:
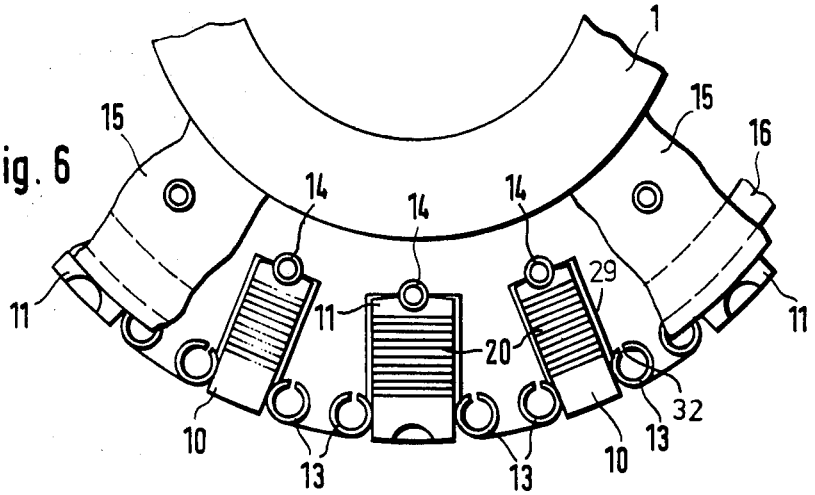
FIG. 6 is a view similar to FIG. 4 of a third embodiment of the working rolls.

Referring now to FIG. 6, it may be seen that the tools 10, 11 are located in essentially rectangular recesses 29 uniformly spaced about the circumference of the embossing rolls 1, 1'. In order to provide an elasticity and fixation of the forming tools 10, 11 during their tilting movement about the hinge bolts 14, sleeves 13 are provided at each side of the tools 10, 11 at the periphery of the rolls 1, 1'. The support of the sleeves 13 is provided by the walls of the recesses 29 and the rolls 1, 1'. The sleeves 13 extend parallel to the axis of the rolls 1, 1' and are provided with a slot 32 in longitudinal direction thereof to afford the elasticity during the tilting motion.

In a similar manner, as already described in connection with FIG. 5, the tools 10, 11 according to FIG. 6 are also provided with lateral grooves 20 which are engaged by respective rings 16 to obtain a secure fixation of the tools 10, 11.

Figure 7:
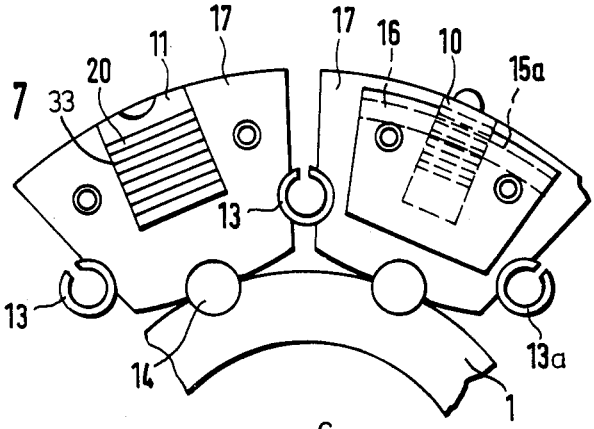
FIG. 7 is a view similar to FIG. 4 of a fourth embodiment of the working rolls.

It is, however, also feasible to accommodate the tools 10, 11 in separate tool holders 17 as illustrated in FIG. 7 which shows the individual tool holders 17 as being uniformly spaced about the periphery of the rolls 1, 1' and connected to the latter via hinge bolts 14 about which the holders 17 can tilt due to their curved base line facing the rolls 1, 1'. At a central location, the holders 17 are provided with recesses 33 which are open at their lateral faces and accommodate the forming tools 10, 11 in a rigid manner. The forming tools 10, 11 are clamped within the recesses 33 of each holder 17 by support disks 15a which cover the open sides and cooperate with rings 16a which engage the respective tool 10, 11. Inbetween two adjacent holders 17, a longitudinally slit sleeve 13a is arranged which resiliently supports the holders 17 against each other and allows the tilting motion thereof but—once shaping of the metal strip 3 is performed—returns the latter into its original position in which the center line of the respective tool 10, 11 crosses the center $C_1$, $C_2$ of the associated roll 1, 1'. The sleeves 13a are fixed at both sides by respective disks which, however, are not illustrated in FIG. 7.

In order to obtain a tilting motion of the tool holder 17 without interference with one of its adjacent holders, the arrangement of the sleeve 13a with adjacent hinge bolts 14 is such that the connecting lines between their respective center axes define a right angle.

Figure 8:
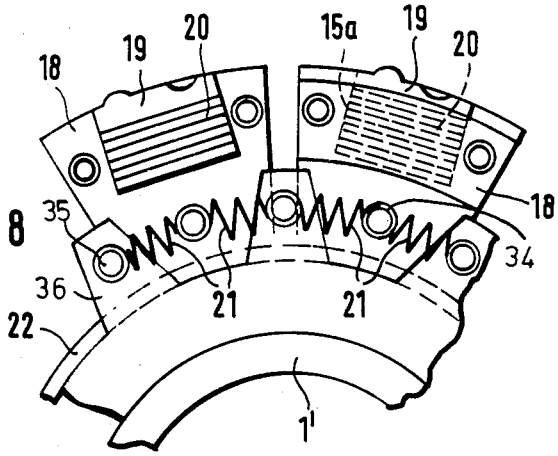
FIG. 8 is a view similar to FIG. 4 of a fifth embodiment of the working rolls.
Figure 11:
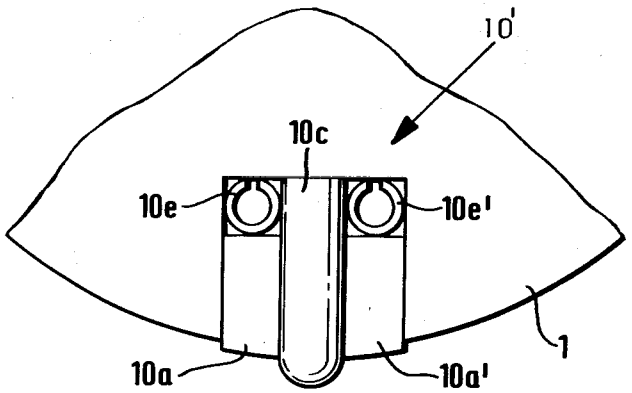
FIGS. 9 and 11 in views similar to FIG. 4 illustrate a multipart male die of the working rolls.
Figure 12:
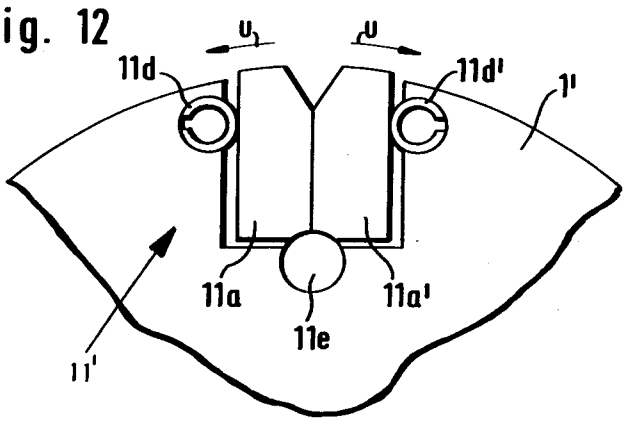
FIGS. 10 and 12 in views similar to FIG. 4 illustrate a multipart female die of the working rolls.
Figure 9:
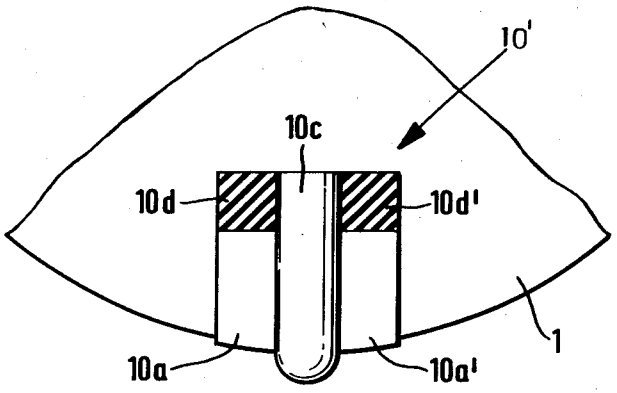
Figure 10:
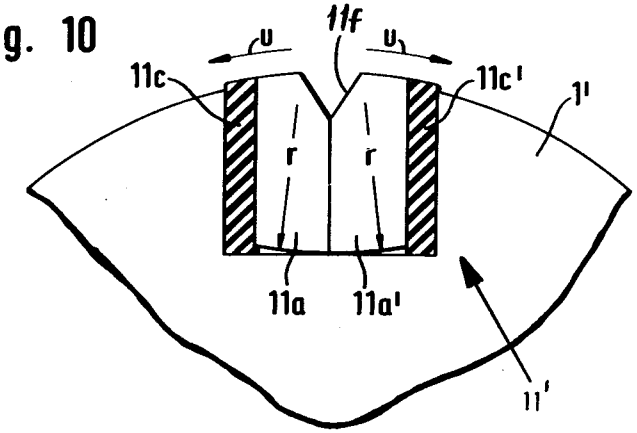

In FIG. 8, tool holders 18 are shown which differ to the holders 17 as illustrated in FIG. 7 in that they are movable along a guide path 22 provided about the circumference of the roll 1, 1' in a sliding manner and thus do not perform a tilting motion. The sliding motion of the holders 18 is obtained by means of springs 21. Each spring 21 extends between a pin 34 located at a central position of each holder 18 transversely thereto and a pin 35 of an associated lug 36. The lugs 36 project from the circumference of the rolls 1, 1' in direction towards the holder 18 and are arranged in such a manner that the pins 34 and pins 35 and thus the supports for the springs 21 are provided along the same graduated circle.

As it further shown in FIG. 8, each holder 18 accommodates a forming tool 19 having a male die as well as a female die. The attachment of the tools 19 is also provided with support disks 15a which cover the laterally open faces of the recesses 33 in a manner already described.

Turning now to FIGS. 9 to 12 which illustrate multipart forming tools 10', 11', it may be seen that the male die 10' includes portions 10a, 10a' which serve as pressure pads and are resiliently supported in radial direction by elastic rubberlike support members which may be elastic cushions 10d, 10d' or metallic springs as e.g. longitudinally slit sleeves 10e, 10e'. Extending through the portions 10a, 10a' is a stamp die 10c which projects beyond the periphery of the working roll 1 and cooperates with a groove 11f defined by the body portions 11a, 11a' of the female die 11'. The portions 11a, 11a' are resiliently supported in circumferential direction u of the roll 1' by elastic rubber-like support members constituted by elastic cushions 11c, 11c' or metallic springs as e.g. longitudinally slit sleeves 11d, 11d' arranged at each side of the body portions 11a, 11a'. Due to the elasticity of both the male die 10, and female die 11', the penetration of the stamp die 10c into the plane of the strip 3 varies in dependence on the relative positioning of the rolls 1, 1' so that formations or deformations 12 of different depth can be provided in the strip 3.

In order to provide the tilting motion of the female die 11', i.e. of the body portions 11a, 11a', the latter are provided with a curved base with a radius r (FIG. 10) or are supported by a central hinge bolt 11e located opposite the groove 11f about which the body portions 11a, 11a' can tilt.

As already described, e.g. in FIG. 4, the tool portions 10a, 10a', 10c, 11a, 11a' can be provided with lateral grooves 20 which are engaged by rings 16 according to FIG. 5. Moreover, the male and female die 10', 11' can be accommodated in respective recesses of the working rolls 1, 1' with additional elastic support of the tool portions 10a, 10a' in circumferential direction u, e.g. by elastic cushions 12 as illustrated in FIG. 4 or by longitudinally slit sleeves 13 as illustrated in FIG. 6. In addition, it is certainly feasible to insert the multipart forming tools 10', 11' also in tool holders 17 or 18 as shown in FIG. 7 or FIG. 8.

We claim:

1. An apparatus for shaping a strip, comprising:

at least one pair of working rolls provided with forming tools spaced about their circumference for embossing an edge of the strip;

at least one pair of guide rolls located upstream of said pair of working rolls and running in synchronism with the advance speed of the strip;

a roller provided between said pair of working rolls and said pair of guide rolls and being movable in a direction perpendicular to the advance plane of the strip for deflecting the latter out of said plane;

a resilient means positioned perpendicular to said advance plane, supporting said roller and urging the roller to abut against the strip;

gear means including bevel gears and a connection shaft coupling with one another and said pair of working rolls to said pair of guide rolls wherein said pair of working rolls has a circumferential speed higher than the advance speed of the strip.

2. An apparatus as defined in claim 1 wherein said resilient means includes trunnions connected to said roller, a casing for each of said trunnions and a spring accommodated in said casing, each of said trunnions projecting into said casing and being supported by said spring so as to be movable within said casing.

3. An apparatus as defined in claim 2 wherein said roller is provided with a jacket of elastic material.

4. An apparatus as defined in claim 1, further comprising another such roller provided downstream of said pair of working rolls.

5. An apparatus as defined in claim 1, further comprising supporting means integral with and positioned along the circumference of said working rolls carrying said forming tools in such a manner that an elastic movement of said forming tools in circumferential direction of said working rolls is provided.

6. An apparatus as defined in claim 5 wherein said supporting means is provided with recesses for accommodating said forming tools, said supporting means including a hinge bolt provided at the base of each recess so as to allow a tilting motion of said forming tool about said hinge bolt and resilient elements lined at the wall of said recesses for supporting said forming tool in said circumferential direction.

7. An apparatus as defined in claim 6 wherein said resilient elements are longitudinally slit sleeves.

8. An apparatus as defined in claim 6 wherein said resilient elements are made of elastic material in which said forming tools are embedded.

9. An apparatus as defined in claim 6 wherein said recesses are exposed towards the side faces of said working rolls, further comprising support disks covering said exposed side faces to fasten said forming tools therebetween within said recesses.

10. An apparatus as defined in claim 1, further comprising a tool holder positioned along the circumference of said working rolls having a pocket to receive each forming tool, said tool holders being spaced about the circumference of said working rolls in an elastically movable manner.

11. An apparatus as defined in claim 10, further comprising support means beneath said tool holders carrying said tool holders in such a manner that said tool holders are tiltable in circumferential direction of said working rolls in an elastic manner.

12. An apparatus as defined in claim 11 wherein said support means include a hinge bolt connecting each tool holder to said working rolls and resilient elements arranged in between adjacent tool holders to allow mutual support thereof.

13. An apparatus as defined in claim 12 wherein said resilient elements are longitudinally slit sleeves.

14. An apparatus as defined in claim 13 wherein one of said sleeves and adjacent hinge bolts each define a center axis, the connection line between said center axis of said sleeve and said center axes of said adjacent hinge bolts encompass a right angle in a lateral projection of said working rolls.

15. An apparatus as defined in claim 10, further comprising sliding means positioned beneath said tool holders allowing movement of said tool holders in circumferential direction of said working rolls.

16. An apparatus as defined in claim 15 wherein said sliding means includes a plurality of springs having one end connected to said tool holders and another end supported by said working rolls.

17. An apparatus as defined in claim 1 wherein said forming tools include male dies and female dies.

18. An apparatus as defined in claim 1 wherein each of said forming tools is assembled of multiple parts, further comprising resilient means for supporting said forming tools in radial direction and in circumferential direction of said working tools.

* * * * *